US006843183B2

(12) United States Patent
Strong

(10) Patent No.: US 6,843,183 B2
(45) Date of Patent: Jan. 18, 2005

(54) SYSTEM AND METHOD FOR ENHANCED TELESCOPING ENGAGEMENT

(75) Inventor: Lynn Curtis Strong, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/123,768

(22) Filed: Apr. 15, 2002

(65) Prior Publication Data

US 2002/0148394 A1 Oct. 17, 2002

Related U.S. Application Data

(60) Provisional application No. 60/283,658, filed on Apr. 13, 2001.

(51) Int. Cl.[7] ..... A47B 9/20

(52) U.S. Cl. ..... 108/149.21; 248/188.5; 403/109.2; 108/147.19

(58) Field of Search ..... 108/147.21, 147.19, 108/148, 144.11, 106, 107; 248/188.5, 916; 403/109.1, 109.2, 109.3

(56) References Cited

U.S. PATENT DOCUMENTS

| | | | | |
|---|---|---|---|---|
| 1,063,642 A | | 6/1913 | Birdsall | |
| 1,266,929 A | | 5/1918 | Enis | |
| 2,846,278 A | * | 8/1958 | Blazek | 108/147.19 |
| 2,999,729 A | | 9/1961 | Semmelroth | |
| 3,027,209 A | | 3/1962 | Nielsen | |
| 3,410,232 A | | 11/1968 | Krueger | |
| 4,043,277 A | | 8/1977 | Wallace | |
| 4,155,542 A | * | 5/1979 | Jansson | 269/94 |
| 4,191,111 A | | 3/1980 | Emmert | |
| 4,807,836 A | * | 2/1989 | Price et al. | 108/147 |
| 5,107,775 A | * | 4/1992 | Langlais et al. | 108/147.21 |
| 5,349,780 A | * | 9/1994 | Dyke | 248/188.5 |
| 5,385,323 A | * | 1/1995 | Garelick | 248/188.5 |
| 5,556,181 A | * | 9/1996 | Bertrand | 108/147.19 |
| 5,579,557 A | * | 12/1996 | Boden | 403/109.2 |
| 5,617,798 A | * | 4/1997 | Lytell | 108/147.19 |
| 5,678,892 A | * | 10/1997 | Heitlinger | 248/188.5 |
| 5,797,696 A | * | 8/1998 | Baynes et al. | 403/109.2 |
| 5,803,643 A | * | 9/1998 | Patelli et al. | 403/109.1 |
| 5,921,623 A | | 7/1999 | Nye et al. | |
| D419,332 S | | 1/2000 | Collins et al. | |
| 6,347,831 B1 | | 2/2002 | Nye et al. | |

FOREIGN PATENT DOCUMENTS

| | | | |
|---|---|---|---|
| DE | 19952626 | * | 7/2001 |
| EP | 645107 | * | 3/1995 |

* cited by examiner

*Primary Examiner*—Lanna Mai
*Assistant Examiner*—Hanh V. Tran
(74) *Attorney, Agent, or Firm*—Workman Nydegger

(57) ABSTRACT

A telescoping assembly allows the length of an assembly to be readily adjusted. Desirably, the telescoping assembly is used in connection with a table to allow the height of the table to be easily adjusted. The telescoping assembly preferably includes one or more projections formed in telescoping members and the projections provide accurate, low friction contact areas between the telescoping members. Preferably, first and second plurality of projections are provided, and these plurality of projections can be located on either the same telescoping member or different telescoping members. The plurality of projections are preferably evenly distributed about the telescoping members and separated by a given distance, but the projections may be located in any suitable positions and the telescoping assembly can have any appropriate number of projections.

16 Claims, 6 Drawing Sheets

SYSTEM AND METHOD FOR ENHANCED TELESCOPING ENGAGEMENT

CROSS-REFERENCE TO RELATED APPLICATIONS

The present application claims priority to and the benefit of U.S. Provisional Patent Application Ser. No. 60/283,658, entitled System and Method for Enhanced Telescoping Engagement, which was filed on Apr. 13, 2001, and is hereby incorporated by reference in its entirety.

FIELD OF THE INVENTION

The present invention generally relates to adjustable length members. More specifically, the adjustable length members telescopically engage each other and are preferably adjustable into a plurality of different lengths. Advantageously, the adjustable length members can be used to support a table at a desired height and the adjustable length members may form part of a table support assembly.

DESCRIPTION OF RELATED ART

In many devices, it is desirable to have a group of members, or an assembly, that is adjustable in length. A classic example of an assembly that is adjustable in length is a telescoping antenna. A conventional telescoping antenna includes several tubular members that allow the antenna to be retracted into a compact or storage position and extended into a use position. In greater detail, a conventional telescoping antenna includes a number of tubular members with different inner and outer diameters that allow the members to be nested together in the retracted position or extended into the use position. The adjacent tubular members are generally referred to as being in "telescopic engagement" with each other to form the telescoping assembly.

Although there are many applications in which a telescoping assembly may beneficially be incorporated, the use of telescoping assemblies has traditionally been limited because of manufacturing and cost considerations. For example, conventional telescoping assemblies require strict tolerances to ensure that the tubular members can properly nest inside each other in the retracted position. Additionally, conventional telescoping assemblies require strict tolerances to allow adjacent telescoping members to extend into the elongated position. Further, conventional telescoping assemblies require strict tolerances so that the telescoping assembly has a relatively rigid and straight configuration in the extended position. Finally, conventional telescoping assemblies are not able to support a significant load or weight because the weight causes the telescoping assembly to retract into the storage position.

Conventional telescoping assemblies are relatively expensive and time consuming to manufacture because, inter alia, of the strict tolerances required for the inner and outer diameters of each of the telescoping members. In particular, if the clearance or space between adjacent telescoping members is too large, the telescoping members may not stay aligned along the same axis and the members may undesirably move or "wobble." That is, the telescoping members do not remain coaxial and there is excessive amount of motion or "slop" between the telescoping members. This undesired movement or slop causes the telescoping assembly to appear somewhat rickety and unstable, and often creates an impression of poor workmanship and quality in the mind of the consumer or user. This undesired movement may also cause the device to be unstable, unbalanced and, in some situations, unusable. On the other hand, if clearance between adjacent telescoping members is too small, the parts may not fit together or the telescoping members may be difficult if not impossible to move between the extended and retracted positions because of friction or interference between the members. That is, the friction or interference between the telescoping members may cause the members to bind together and hinder or prohibit the movement of the telescoping members. This "binding" of the telescoping members prevents the smooth, even movement of the members between the extended and retracted positions and, in contrast, causes undesirable rough and erratic movement of the telescoping members. This binding may also make the telescoping assembly difficult or impossible to use, and also maybe interpreted as a sign of poor quality or workmanship.

In order to prevent undesirable lateral movement and binding of the telescoping members, the telescoping members must be manufactured with a very limited or "tight" tolerances for error. That is, the acceptable ranges of the dimensions for the inner diameter, outer diameter and roundness for the telescoping members must be carefully limited. Disadvantageously, limiting the tolerances of these dimensions significantly increases the costs and the manufacturing time. For example, a component with small or tight tolerances typically requires additional testing, extra inspection, a higher rate of reworking the parts, and increased failure rate.

It is known to construct tables that are adjustable in height. A wide variety of different methods and devices have been used to allow the height of a table top to be varied. Advantageously, tables with an adjustable height can be set at different heights according to the desired height of the user. For example, the height of the table can be adjusted for children or adults. Additionally, it may be desirable to adjust the height of the table depending upon the desired use of the table. For example, the table may have one height if it is being used to hold food for a buffet line or a different height for use while people are sitting to eat.

The use of telescoping assemblies to allow the height of tables to be adjusted, however, creates numerous problems. For example, conventional telescoping assemblies allow the table legs to undesirably move or wobble. Disadvantageously, this makes the table unstable and unsteady, which often hinders or limits the effective use of the table. In addition, the binding or rough movement of the telescoping members makes the table difficult, if not impossible, to adjust. Further, the binding often makes it difficult to draw the legs out to the desired height and return them to the storage position. Tightening the tolerances of the telescoping members, however, may make the telescoping assemblies prohibitively expensive.

BRIEF SUMMARY OF THE INVENTION

A need therefore exists for a telescoping assembly that eliminates the above-described disadvantages and problems.

One aspect of the present invention is a telescoping assembly that allows the length of the assembly to be quickly and easily modified or adjusted. Significantly, the telescoping assembly allows the generally smooth, even and unimpeded movement of the telescoping members between the extended and retracted positions. That is, the telescoping members do not bind, lock or get stuck while the length of the telescoping assembly is being adjusted.

Another aspect of the telescoping assembly is the telescoping members remain generally aligned along the same axis whether the members are in the extended or retracted position. Advantageously, because the telescoping members remain generally aligned along the same axis, that prevents undesired lateral movement or slop. This allows a telescoping assembly to be created that is more stable and secure, which allows more sturdy and stable structures to be constructed.

Still another aspect of the telescoping assembly is it can be used in connection with a table, which allows the height of the table to be quickly and easily adjusted. Additionally, because the telescoping members remain generally aligned along the same axis and the telescoping members do not bind or get stuck while adjusting the length of the members, a secure and readily adjustable table is created.

Yet another aspect of the telescoping assembly is the telescoping members remain generally aligned along the same axis and are easily adjustable between the extended and retracted positions without requiring strict manufacturing tolerances. In particular, the telescoping assembly does not require strict manufacturing tolerances for the inner diameter, outer diameter or roundness of the telescoping members. Thus, the telescoping assembly does not significantly increase the cost while greatly improving the quality and reliability of the telescoping members.

Yet another aspect of the telescoping assembly is it can be used in connection with table support legs or table support pedestals to support the table top at a desired height. Significantly, the telescoping assembly can also be easily incorporated into a table design with folding legs to provide a table that is easy to set up, fold, and adjust. Thus, the telescoping assembly may also be used to create a table with foldable legs that is relatively secure and stable while the legs are in the extended position, and allows the legs to be quickly and easily folded into the storage position.

A further aspect of the telescoping assembly is it may simply consist of a single exterior telescoping member and a single interior telescoping member that is sized and configured to allow the interior telescoping member to move within an opening that extends through the exterior telescoping member. Preferably, the exterior and interior telescoping members are tubular members with a generally circular configuration. An annular gap or space is located between the interior and exterior telescoping members to allow the relatively free and unimpeded movement of the members. It will be appreciated that the telescoping assembly can include any desired number of telescoping members depending, for example, upon the desired length or use of the telescoping assembly.

Another aspect of the telescoping assembly is a first plurality of outwardly extending projections may be formed on the outer surface of the interior telescoping member and these projections are sized and configured to contact the inner surface of the exterior telescoping member. Additionally, a second plurality of outwardly extending projections may be formed on the outer surface of the interior telescoping member and these projections are also sized and configured to contact the inner surface of the exterior telescoping member. The interior telescoping member is slidably disposed within an exterior telescoping member and the first and second plurality of projections are sized and configured to contact the inner surface of the exterior telescoping member.

Yet another aspect of the telescoping assembly is the exterior telescoping member may include a first plurality of inwardly extending projections that are formed on the inner surface and these projections are sized and configured to contact the outer surface of the inner telescoping member. Additionally, a second plurality of inwardly extending projections are formed on the inner surface of the outer telescoping member and these projections are also sized and configured to contact the outer surface of the inner telescoping member.

The projections formed in the inner and outer telescoping members may be in the form of a dimple with a generally rounded configured. The dimples are preferably sized and configured to extend across the annular gap between the inner and outer telescoping members, and to engage or contact the adjacent telescoping member. The dimples allow the telescoping members to remain generally aligned along the same axis and prevent the telescoping members from unintentionally binding or locking together while the length of the assembly is being adjusted. The projections or dimples may have any suitable size and configuration depending, for example, upon the intended use of the telescoping assembly.

Advantageously, the dimples or projections can be easily formed in the inner and/or outer telescoping members. For example, the dimples may be formed in the exterior telescoping member by pressing hard, rounded objects into the exterior surface of the member to form inwardly extending dimples on the inner surface of the member. These inwardly extending dimples may appear as bumps on the interior surface of the exterior telescoping member. Similarly, dimples may be formed in the interior telescoping member by pressing hard, rounded objects into the inner surface to form outwardly extending dimples on the outer surface. The dimples formed on the outer surface of the interior telescoping member may appear as a plurality of outwardly extending bumps.

As discussed above, the projections or dimples can extend outwardly from the interior telescoping member or extend inwardly from the exterior telescoping member. Alternatively, if desired, one or more projections or dimples may be formed in both the interior and exterior telescoping members.

The projections or dimples are preferably sized and configured to extend across the annual gap to provide contact points against the adjacent telescoping member. Preferably, the first and second plurality of projections each contain three or more projections that extend radially outward or inward about the same distance and the projections are preferably generally equally spaced about the telescoping member. The projections are desirably positioned so that the telescoping members remain generally aligned along the same axis. More desirably, the first plurality of projections maintain the concentricity of the telescoping members at a first location and the second plurality of projections maintain the concentricity of the telescoping members at a second location. Advantageously, if the interior and exterior telescoping members are generally concentrically located at two points along their length, they are generally concentrically positioned along their entire length. That is, the telescoping members are generally coaxially aligned by the first and second pluralities of projections.

Another aspect of the telescoping assembly is the projections desirably remain in contact with the adjacent telescoping member to minimize undesired lateral movement or slop between the telescoping members. Advantageously, because the projections remain in contact with the adjacent telescoping member, the size of the annular gap is not critical. Thus, the size of the annular gap may vary because as long as the adjacent telescoping members are positioned relatively close to each other such that the plurality of projections maintain contact between the members, the telescoping members can movement relative to each other along generally the same axis. Additionally, the undesired lateral movement or slop between the adjacent telescoping members is minimized because of the contact or engagement of the projections with the adjacent telescoping member. Accordingly, the size of the annular gap does not affect the operation of the telescoping assembly. Further, the telescoping members can be manufactured with comparatively loose tolerances as long as the projections are formed with accuracy. Finally, binding of the telescoping members is minimized because the contact areas between the ends of the projections and the adjacent telescoping members are relatively small. As a result, burrs, scratches, and the like do not inhibit the relative movement of the telescoping members.

Still another aspect of the telescoping assembly is the first and second pluralities of projections may be configured in a wide variety of ways. For example, the first and second plurality of projections could be formed in the outer telescoping member and oriented to extend inwardly to contact with the interior telescoping member. This configuration may be particularly advantageous because it can be manufactured with comparative ease. For example, an arbor, consisting of an elongated block with a circular or polygonal cross-sectional shape, may be inserted into the exterior member and fixed into a coaxial position with respect to the exterior member. The exterior member and the arbor may then be inserted into a collet and fixed with respect to the collet. The collet may have a plurality of arcuate blocks, each of which faces inwardly toward a flat or rounded face of the arbor. Each of the arcuate blocks may include a bump or protuberance on the interior face which, when the collet is compressed around the exterior member, presses into the exterior member to form the projections or dimples. When the projections reach the flat faces of the arbor, the projections reach their maximum allowed inward displacement, which accurately controls the size of the projections and provides the proper amount of clearance between the telescoping members. Advantageously, this allows the projections to be formed with a high degree of accuracy without significantly increasing manufacturing costs.

Yet another aspect of the telescoping assembly is the plurality of projections may be configured to extend outwardly from the outer surface of the interior telescoping member to contact with the exterior telescoping member. As discussed above, the projections are preferably sized and configured to allow the telescoping members to move longitudinally along generally the same axis and to prevent undesirably lateral movement. Advantageously, if the projections are located on the interior telescoping member, the projections hidden from view.

Desirably, the outwardly extending projections formed on the outer surface of the interior telescoping member may be formed using a similar process to that described above. For example, collet with bumps or protuberances on the exterior faces may be inserted into the interior telescoping member, and may be actuated to press the bumps into the interior telescoping member to form outwardly extending projections. A rim or other similar device maybe positioned around the interior telescoping member during formation of the projections to limit the size of the projections to provide the proper amount of clearance with the exterior telescoping member.

Still another aspect of the telescoping assembly is the first plurality of projections may be formed in one telescoping member and the second plurality of projections may be formed in the adjacent telescoping member. Thus, the first and second plurality of projections are separated by a distance that varies according to the relative position of the interior and exterior telescoping members. Therefore, the telescoping members have a comparatively smaller amount of lateral movement or slop when the first and second plurality of projections are far apart, such as when the telescoping members are fully nested. Conversely, when the telescoping members are fully extended, the amount of lateral movement or slop may increase because the first and second plurality of projections are closer together. This configuration may be particularly advantageous in applications in which the telescoping members are not usually fully extended.

Significantly, the telescoping assembly is relatively easy to manufacture because the manufacturing tolerances for the inside diameter, outside diameter, and straightness of the interior and exterior telescoping members may be relaxed while slop and binding are reduced. Additionally, the telescoping assemblies are less expensive, more attractive, more stable, and easier to use. Further, the telescoping assemblies may be easier to assemble because less time and effort is required to connect the telescoping members.

These and other aspects, features and advantages of the present invention will become more apparent from the following detailed description of preferred embodiments and appended claims.

BRIEF DESCRIPTION OF THE DRAWINGS

The appended drawings contain figures of preferred embodiments of the telescoping assembly. The above-mentioned features, aspects and advantages of the telescoping assembly, as well as other features, aspects and advantages, will be described in connection with these preferred embodiments. The illustrated embodiments, however, are only intended to illustrate the invention and not limit the invention. The drawings contain the following figures.

DETAILED DESCRIPTION OF THE PREFERRED EMBODIMENTS

The present invention involves a telescoping assembly that is adjustable in length. Preferably, the telescoping assembly is used in connection with a table to create a table with an adjustable height. The principles of the present invention, however, are not limited to tables with adjustable height. It will be understood that, in light of the present disclosure, the telescoping assembly disclosed herein can be successfully used in connection with other types of tables, devices and mechanisms.

Additionally, to assist in the description of the telescoping assembly, words such as inner, outer, interior, exterior, distal and proximal are used to describe the accompanying figures. It will be appreciated, however, that the components of the present invention could be arranged into a variety of suitable configurations. A detailed description of various preferred embodiments of the telescoping assembly now follows.

Figure 1:
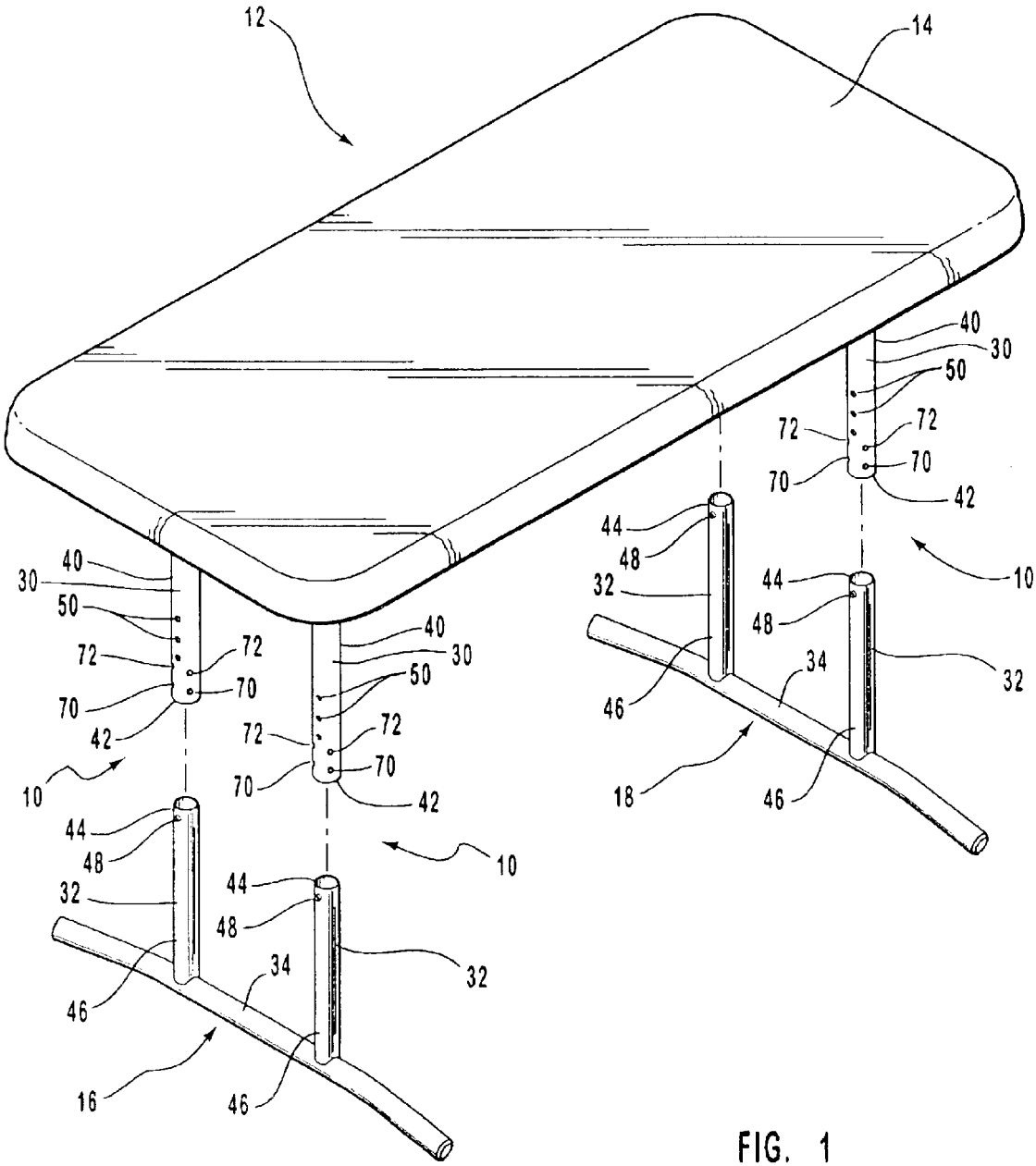
FIG. 1 is an exploded, perspective view of a telescoping assembly in accordance with a preferred embodiment of the present invention, illustrating the telescoping assembly in connection with a utility table with adjustable legs or support pedestals.

As seen in FIG. 1, two telescoping assemblies 10 form part of a table 12 with an adjustable height. The table 12 includes a table top 14, which is preferably disposed in a substantially horizontal orientation during use of the table, a first support pedestal or leg 16 and a second support pedestal or leg 18 that support the table top at a desired height above a surface such as the ground. If desired, the first and second support pedestals or legs 16, 18 may be configured to fold inwardly against the table top 14 so that the table 12 can be stored in a compact form. That is, the legs 16, 18 may be foldable between an extended position as shown in FIG. 1 where the legs extend generally perpendicularly from the table top 14, and a storage position where the legs are folded adjacent to the underneath surface of the table top and the legs are positioned generally parallel to the table top.

As shown in FIG. 1, each of the support pedestals 16, 18 includes a pair of telescoping assemblies 10 that allow the height of the support pedestals to be adjusted. One skilled in the art will appreciate that the table 12 may include any suitable number of telescoping assemblies 10 to allow the table to be adjustable. For example, if the support pedestals 16, 18 include only a single upright member, then the support pedestals may only require a single telescoping assembly. On the other hand, the table 12 may include three or more legs and each of the legs may include a telescoping assembly 10 to allow the length of the legs to be adjusted.

As shown in the accompanying figures, the support pedestals 16, 18 each include a pair of telescoping assemblies 10. The telescoping assemblies 10 include an exterior telescoping member 30 and an interior telescoping member 32 that is sized and configured to slide within an opening in the exterior telescoping member. It will be appreciated that the telescoping members 30, 32 preferably have a tubular configuration with a generally circular cross-section, but the telescoping members can have any suitable size and shape such as oval, elliptical, square, rectangular, triangular, or a polygon with any number of desired sides, depending, for example, upon the intended use of the telescoping assembly 10. Thus, while the following detailed description and accompanying figures may describe the telescoping members 30, 32 has having a generally tubular configuration, it will be understood that the telescoping members can have any suitable configuration.

The support pedestals 16, 18 preferably include a cross bar 34 that is attached to the telescoping assemblies and configured to support the table 10 on a surface such as the ground. The cross bar 34 preferably has a slight bend or arc so that only the ends of the cross bar contact the supporting surface. In particular, the cross bar 34 preferably includes a first angled section such that a first end of the cross bar is angled towards the supporting surface and a second angled section such that a second end of the cross bar is angled towards the supporting surface. It will be appreciated that the cross bar 34 may have any suitable configuration and the use of the cross bar is not required.

As shown in FIG. 1, each of the exterior telescoping members 30 includes a first end 40 that is disposed proximate the table top 14 and a second end 42 that is disposed towards the cross bar 34. Each of the interior telescoping members 32 includes a first end 44 that is disposed towards the table top 14 and a second end 46 that is attached to the cross bar 34. The exterior and interior telescoping members 30, 32 are sized and configured to allow the interior telescoping members to be slidably inserted into openings within the exterior telescoping members. The movement of the interior telescoping member 32 relative to the exterior telescoping member 30 allows the length of the telescoping assembly 10 to be adjusted, which allows the height of the table 12 to be adjusted.

The interior and exterior telescoping members 30, 32 can be held in a fixed relative position by a locking member 48 that locks the telescoping members in position. The locking member 48 is preferably a spring-loaded button or pin that protrudes from the interior telescoping member 32. The locking member 48 includes an outwardly extending portion that is sized and configured to fit into one of a series of locking holes 50 located in the exterior telescoping member 30 so that the telescoping assembly 10 can be locked in a plurality of different lengths, according to a user's desire. One of ordinary skill in the art will appreciate that the locking member 48 may have other suitable configurations and designs such as a locking pin, detent, removable fastener, and the like. Additionally, the locking member 48 may be attached to the exterior telescoping member 30 and be sized and configured one or more apertures or detents formed in the interior telescoping member 32.

The telescoping assemblies 10 preferably include a plurality of projections or dimples to allow the telescoping members 30, 32 to freely move relative to each other. Advantageously, the plurality of projections or dimples also assist in keeping the telescoping members 30, 32 aligned along the same axis. In particular, as seen in FIG. 1, in this embodiment of the telescoping assembly 10, the exterior telescoping member 30 includes a plurality of inwardly extending projections or dimples. Preferably, the exterior telescoping member 30 includes a first plurality of inwardly extending projections 70 and a second plurality of inwardly extending projections 72, but it will be appreciated that the telescoping member can have any suitable number of projections.

Figure 2:
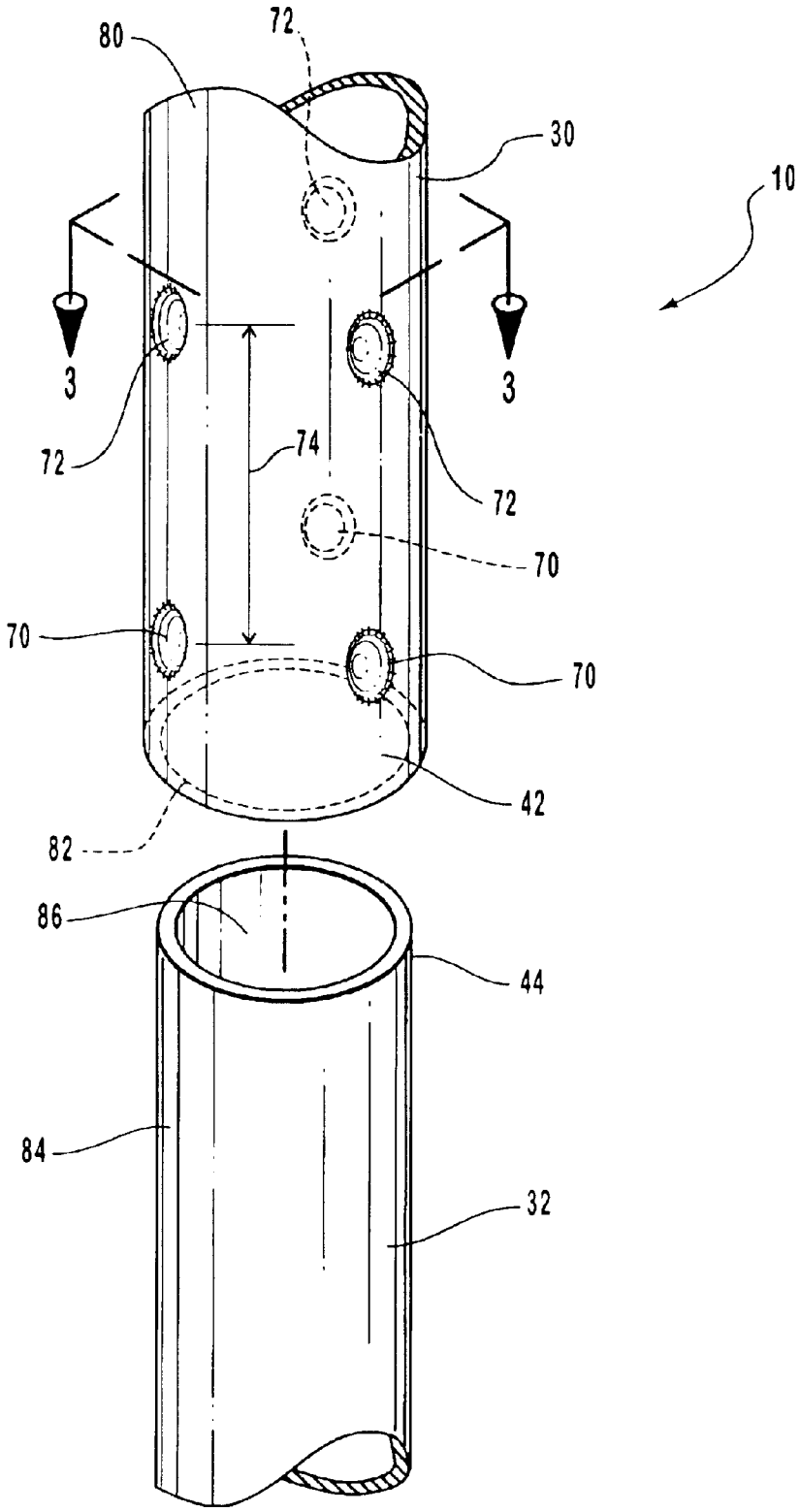
FIG. 2 is an enlarged, perspective view of a portion of the telescoping assembly shown in FIG. 1, illustrating a plurality of inwardly extending projections on an inner surface of an exterior telescoping member.

As shown in FIG. 2, which is an enlarged view of one of the telescoping assemblies 10 shown in FIG. 1 with the locking member 48 and the locking holes 50 omitted for clarity, the first and second pluralities of projections 70, 72 consist of a plurality inwardly extending projections that are spaced apart around the circumference of the exterior telescoping member 30. As shown in the accompanying figure, each of the first and second pluralities of projections 70, 72 preferably consists of three inwardly extending projections that are spaced a generally equidistance apart, but one skilled in the art will appreciate that any suitable number of projections may be utilized and the projections may be located in any desired positions. Additionally, as shown in FIG. 2, the first plurality of projections 70 are preferably spaced proximate or near the second end 42 of the exterior telescoping member 30 and the second plurality of projections 72 are spaced a distance away from the second end of the telescoping member and the first plurality of projections. As discussed below, the plurality of projections 70, 72 may be separated by any suitable distance depending, for example, upon the intended use of the telescoping assembly 10.

As shown in the accompanying figures, the projections or dimples 70, 72 preferably have a generally circular base with a rounded or dome shaped outwardly extending portion. The projections 70, 72, however, may also include a variety of other appropriate shapes and configurations, such as outwardly extending protrusions with generally square, rectangular or oval bases; and outwardly extending protrusions with flat-faced outer portions, plateaus with rounded or flat-sided perimeters, plateaus with concave faces, and the like. The projections 70, 72 are preferably integrally formed as part of the telescoping members 30, 32, but the projections may also be separate structures that are affixed or attached to the telescoping members.

The telescoping members 30, 32 are preferably constructed from a material that allows the projections to be formed without damage to the member. For example, the telescoping members 30, 32 may be constructed from a relatively malleable or ductile material to allow the projections to be integrally formed in the members. Accordingly, while materials such as steel, aluminum or plastic are preferably used to construct the telescoping members 30, 32, any materials with the appropriate properties may be used to construct the telescoping members. Additionally, the telescoping members 30, 32 preferably have a relatively thin outer wall which allows the projections 70, 72 to be formed without creating large bending stresses during the formation of the projections, but the wall may have any suitable thickness depending, for example, upon the configuration of the wall or the intended use of the telescoping assembly 10.

As shown in FIG. 2, the first and second pluralities of projections 70, 72 are separated by a fixed distance 74. The distance 74 is preferably selected to minimize wobbling or relative lateral motion of the exterior and interior telescoping members 30, 32. In particular, the plurality of projections 70, 72 are preferably separated by a distance 74 so that the telescoping members 30, 32 remain generally aligned along the same axis, regardless of how far the interior telescoping member 32 extends from the exterior telescoping member 30 as long as the first and second plurality of projections remain in contact with the accompanying telescoping member. The fixed distance 74 is preferably great enough to minimize wobbling, but is preferably not so large that the range of relative movement of the telescoping members 30, 32 is significantly limited.

As seen in FIG. 2, the interior and exterior telescoping members 30, 32 preferably have a generally circular cross-section and the plurality of projections 70, 72 preferably extend inwardly from the exterior telescoping member towards the interior telescoping member. In particular, the exterior telescoping member 30 preferably has a generally tubular configuration with an inner surface 80 and an outer surface 82. Similarly, the interior telescoping member 32 preferably has a generally tubular configuration with an outer surface 84 and an inner surface 86. When the interior telescoping member 32 is inserted into the exterior telescoping member 30, there is a gap or clearance between the inner surface 82 of the exterior telescoping member 30 and the outer surface 84 of the interior telescoping member 32.

Conventional telescoping mechanisms required the size and shape of this clearance or gap between the telescoping members to be carefully regulated. In particular, the size and shape of the outer diameter of the interior telescoping member and the inner diameter of the exterior telescoping member have to be carefully controlled to allow the telescoping members to move relative to each other without binding or being unintentionally locked in place. Additionally, the tolerances of the clearance must be strictly limited so that the telescoping members remain generally aligned along the same axis, especially when the telescoping members are in an extended position. Further, these strict tolerances must extend the length of the telescoping members. These strict tolerances greatly increase the cost, manufacturing time and number of non-conforming parts. Conventional telescoping members that do not have these strict tolerances undesirably cause the telescoping members to bind or get stuck, and allow excessive lateral movement or slop.

Advantageously, the plurality of projections 70, 72 allow the telescoping members 30, 32 to be manufactured without the previously required strict tolerances, and the projections minimize binding and undesired lateral movement. In particular, the first and second plurality of projections 70, 72 allow the clearance between the inner surface 82 of the exterior telescoping member 30 and the outer surface 84 of the interior telescoping member 32 to be as large as desired, as long as the first and second plurality of projections are formed with the appropriate size and configuration. A method of rapidly and easily forming the first and second plurality of projections 70, 72 with suitable sizes and configurations will be shown and described subsequently.

Figure 3:
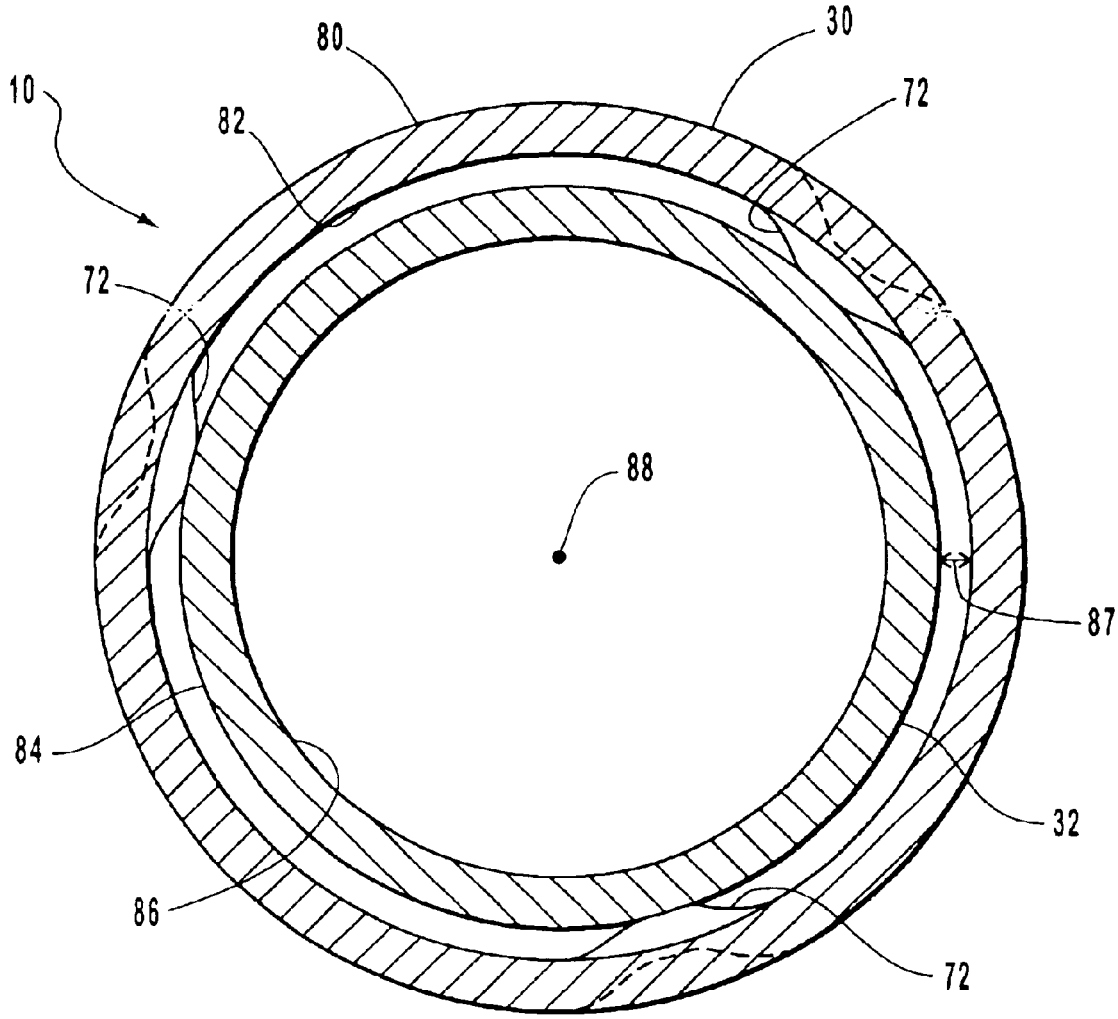
FIG. 3 is a cross-sectional side view along lines 3—3 of the telescoping assembly shown in FIG. 2.

As shown in FIG. 3, which is a cross-sectional view of the telescoping assembly 10, a gap or clearance 87 is located between the inner surface 82 of the exterior telescoping member 30 and the outer surface 84 of the interior telescoping member 32. Preferably, when the telescoping members 30, 32 have a generally tubular configuration, the gap 87 is an annular gap but the gap may have any suitable configuration depending upon the size and shape of the telescoping members.

In the embodiment shown in FIGS. 1–3, the plurality of projections 70, 72 extend inwardly from the exterior telescoping member 30 towards the interior telescoping member 32. In particular, the plurality of projections 70, 72 extend across the gap 87 and contact the outer surface 84 of the interior telescoping member 32. Desirably, the engagement of the projections 70, 72 with the outer surface 84 of the interior telescoping member 32 allow the interior and exterior telescoping members to freely move or slide relative to each other along a longitudinal axis. Significantly, the limited area of contact or engagement between the interior and exterior telescoping members allows the members to slide freely and smoothly without binding or getting stuck. The projections 70, 72 also generally align the interior and exterior telescoping members 30, 32 along a longitudinal axis 88. Advantageously, because the projections 70, 72 maintain the telescoping members 30, 32 generally along the same axis, that minimizes any undesired wobble, slop or lateral movement of the telescoping members 30, 32. Significantly, this creates a telescoping assembly 10 with a high degree of stability.

Figure 4:
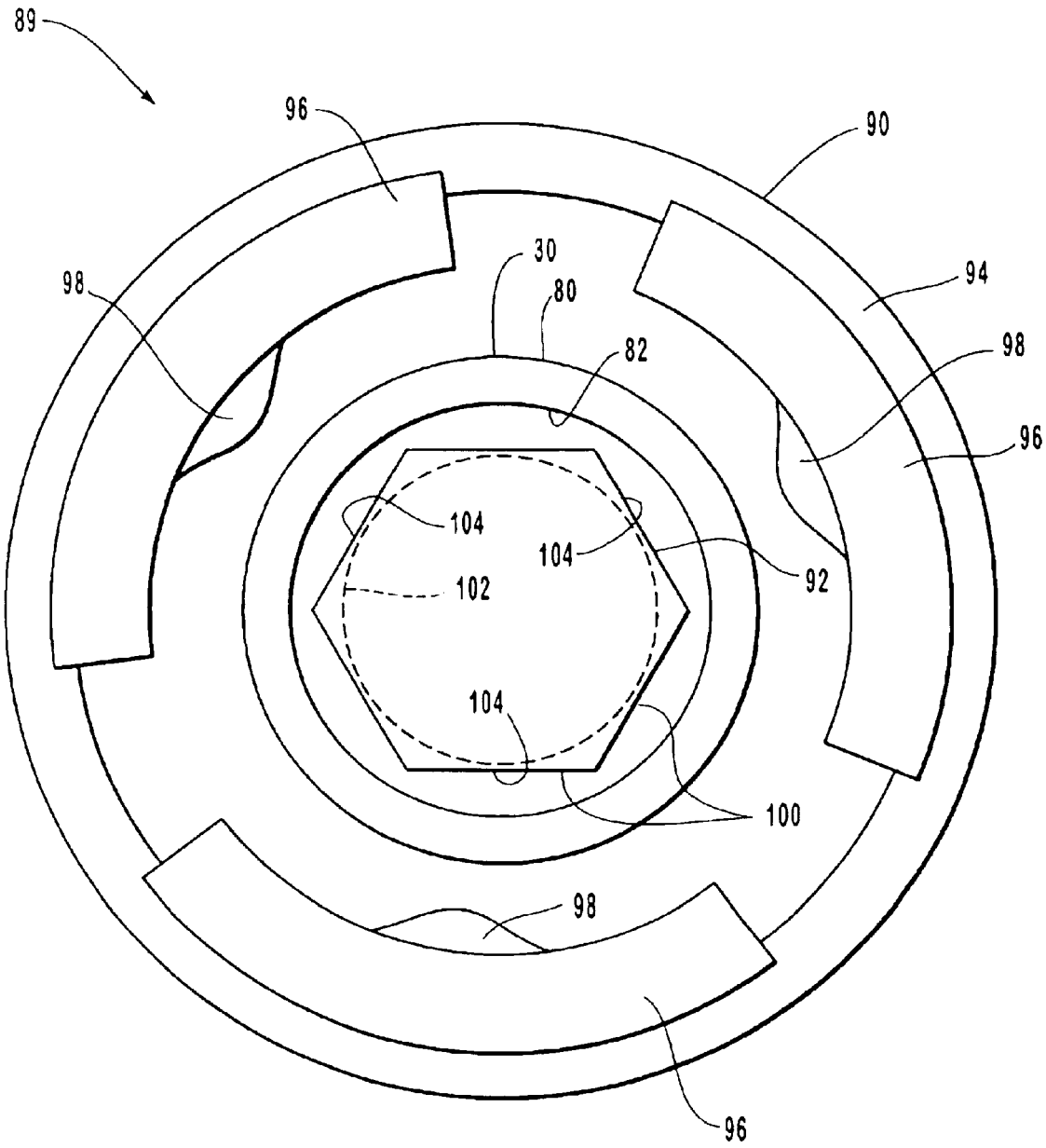
FIG. 4 is a top view of a manufacturing assembly that may be used in connection with a preferred embodiment of the present invention, the manufacturing assembly may be used to form a plurality of inwardly extending projections in an inner surface of an exterior telescoping member.

Referring to FIG. 4, a preferred method of creating the first and second plurality of projections 70, 72 includes a manufacturing assembly 89 with a collet 90 and an arbor 92. The collet 90 is positioned about the circumference of the exterior telescoping member 30 and the arbor 92 is located within the interior of the exterior telescoping member. The collet 90, which maybe similar to collets used to grip objects for lathing operations and the like, includes an outer ring 94 with a fixed diameter and a plurality of arcuate blocks 96. The arcuate blocks 96 are attached to the outer ring 94 in such a fashion that the blocks can be actuated inwardly with respect to the outer ring and towards the outer surface 80 of the exterior telescoping member 30. The inner surfaces of the arcuate blocks 96 include one or more bumps or protrusions 98 that are constructed from a relatively hard or rigid material. The arcuate blocks 96 and protrusions 98 are preferably constructed from a material that is harder than the material used to construct the interior telescoping member 32. For example, arcuate blocks 96 and protrusions 98 may be constructed from hardened steel, tungsten carbide, or other suitable materials. The protrusions 98 preferably have a generally dome shaped configuration in order to create the projections 70, 72, but the protrusions may have any appropriate size and configuration depending, for example, upon the desired size and configuration of the projections.

As shown in FIG. 4, the arbor 92 has a cross section of a polygon with six generally equal sides 100, but the arbor may have any number of sides and any or all of the outer surface of the arbor may be rounded. Desirably, the arbor 92 includes a plurality of generally flat or planar outer surfaces 100 that limit the size of the projections 70, 72. As discussed below, when the projections 70, 72 are being formed by the bumps 98, the outer surfaces 100 of the arbor 92 limit the amount that the projections can inwardly extend.

The arbor 92 is preferably sized and configured to limit the amount that the first and second plurality of projections 70, 72 extend inwardly towards the interior telescoping member 32 to ensure the free and smooth movement of the telescoping members. In particular, the arbor 92 allows the projections 70, 72 to be formed such that the projections extend inwardly a desired amount to contact the outer surface 84 of the interior telescoping member 32, and the arbor prevents the projections from extending so far that it prevents the smooth relative movement of the telescoping members. For example, the cross-section of the arbor 92 may include an inscribed circle 102 within the polygon and the circle may have a diameter that is slightly greater than or equal to the diameter of the outer surface 84 of the interior telescoping member 32. The arbor 92 may also include an inscribed circle 102 with a diameter that is slightly smaller then the diameter of the diameter of the outer surface 84 of the interior telescoping member 32. Thus, the size and configuration of the arbor 92 may be used to determine the size and amount that the plurality of projections 70, 72 extend inwardly from the inner surface 82 of the exterior telescoping member 30. Accordingly, in order to control the size of the projections 70, 72, the arbor 92 is formed of a material harder than that of the exterior telescoping member 30.

In use, the manufacturing assembly 89 is positioned about an end of the exterior telescoping member 30 and the telescoping member is disposed between the outer ring 94 and the arbor 92. The arcuate blocks 96 are actuated inwardly and the bumps 98 press against the outer surface 80 of the exterior telescoping member 30. The comparatively softer material of the exterior telescoping member 30 deforms under the pressure and force of the bumps 98 to create the inwardly extending projections on the inner surface 82 of the exterior telescoping member. The bumps 98 are preferably driven inwardly until the ends of the inwardly extending projections reach corresponding contact points 104 on the outer surfaces 100 of the arbor 92. The engagement of the ends of the projections with the contact points 104 of the arbor 92 limits the inward extension of the projections and this may flatten or deform the ends of the projections. The outer surfaces 100 of the arbor 92, however, remain relatively undeformed because of the hardness of the arbor.

When the inward movement of the projections is stopped by the outer surfaces 100 of the arbor 92, that indicates that the projections are fully formed and the arcuate blocks 96 can be retracted to their original positions to permit removal of the exterior telescoping member 30 from the manufacturing assembly. It will be appreciated that other methods, such as optical sensing, resistance sensing, or the like, may also be used to measure and stop the inward displacement of the bumps 98 so that the projections have the desired size and configuration. Advantageously, even if the bumps 98 press inwardly a larger degree than is required, the resulting projections will simply have a larger flat outer surface but the projections will not extend further inwardly. Thus, the arbor 92 allows projections with the correct size and length to be easily and quickly manufactured by a relatively simple process.

It will be appreciated that numerous other manufacturing processes, including stamping, molding, extrusion, and the like, may be used to create the projections 70, 72 integrally with the exterior telescoping member 30. Additionally, it will be appreciated that the projections 70, 72 need not be integrally formed in the exterior telescoping member 30, but may be formed separately and attached. For example, rounded buttons (not shown) may be made separately constructed from any suitable process and the buttons may then be attached to the exterior telescoping member 30 through chemical bonding, adhesive bonding, welding, mechanical fastening, or the like. Preferably, the buttons are made out of a comparatively low-friction material, which need not be the same material used to construct the exterior telescoping member 30. For example, the buttons may be made of nylon or another polymeric material, and the exterior telescoping member 30 may be made of steel. In addition, alcoves or receiving portions may be formed in the interior surface 82 of the exterior telescoping member 30 to receive the buttons. An adhesive, for example, may be used to attach the button to the exterior telescoping member 30. Such buttons may operate in substantially the same fashion as the integrally formed projections 70, 72 shown in FIGS. 1 through 4.

Figure 5:
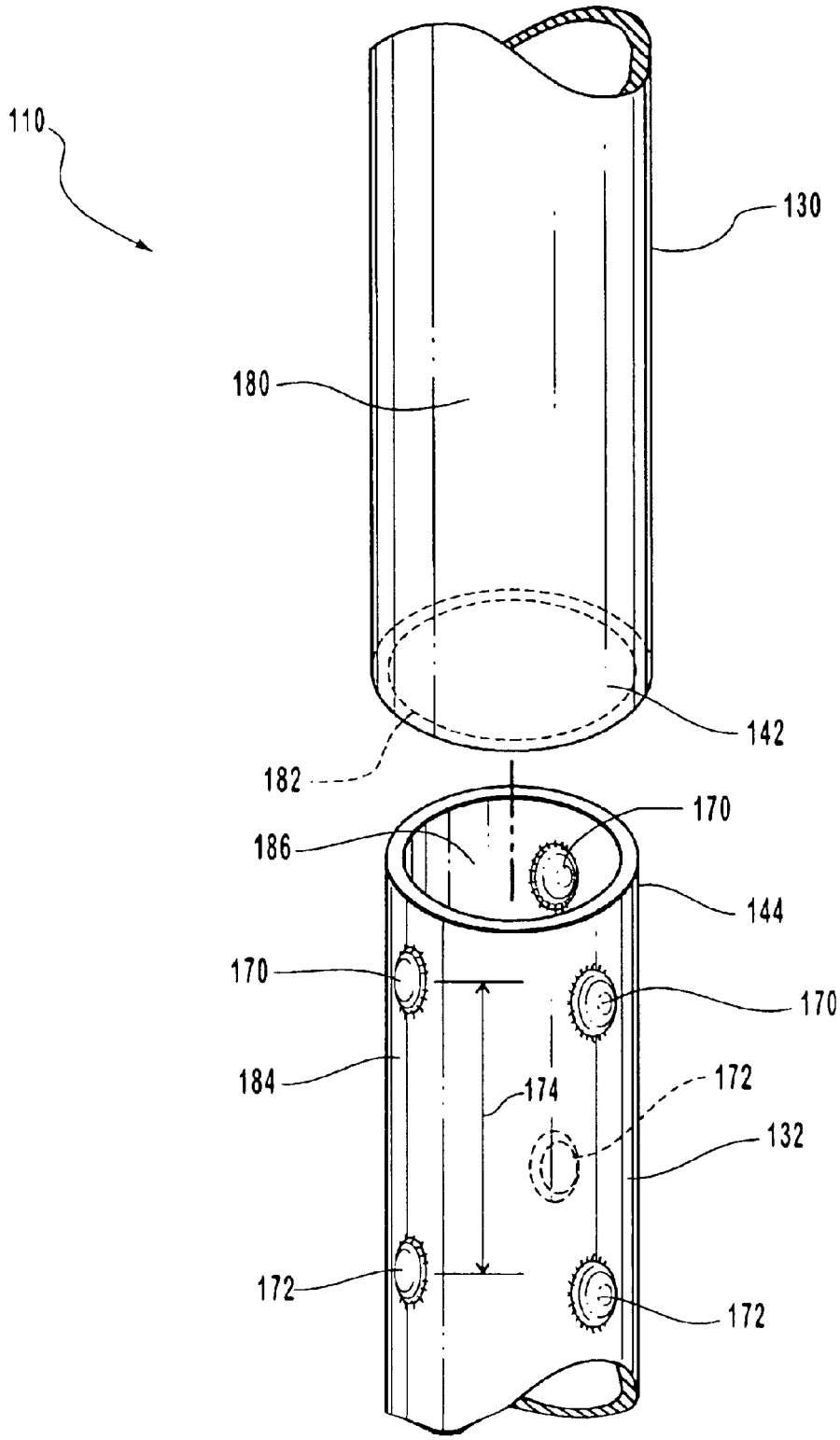
FIG. 5 is an enlarged, perspective view of a portion of a telescoping assembly in accordance with another preferred embodiment of the present invention, illustrating a plurality of outwardly extending projections on an outer surface of an interior telescoping member.

Another embodiment of a telescoping assembly 110 is shown in FIG. 5. Similar to that described above, the telescoping assembly 110 includes an exterior telescoping member 130 and an interior telescoping member 132. The interior telescoping member 132 is sized and configured to fit within the exterior telescoping member 130 with a clearance or annular gap disposed between the telescoping members. The telescoping assembly 110 includes a first and second plurality of outwardly extending protrusions 170, 172 formed on the interior telescoping member 132. The plurality of protrusions 170, 172 are separated by a fixed distance 174 that is large enough to prevent undesired wobbling or slop, and small enough to maintain a comparatively large range of relative motion between the telescoping members 130,132.

In greater detail, the exterior telescoping member 130 includes an outer surface 180 and an inner surface 182, and the interior telescoping member 132 includes an outer surface 184 and an inner surface 186. The protrusions 170, 172 extend outwardly from the outer surface 184 of the interior telescoping member 132, and are sized and configured to contact the inner surface 182 of the exterior telescoping member 130. The protrusions 170, 172 allow the telescoping members 130, 132 to remain generally aligned along the same axis as the telescoping members are extended and retracted. Advantageously, the protrusions 170, 172 have a relatively small contact area, which allows the telescoping members 130, 132 to move smoothly and freely without binding or becoming stuck. The use and operation of the telescoping assembly 110 is similar to that of the telescoping assembly 10, and once again the undesirable lateral movement of the telescoping members 130, 132 and rough movement of the telescoping members is minimized or eliminated.

It will be appreciated that positioning the first and second plurality of projections 170, 172 on the interior telescoping member 132 maybe advantageous in many situations because the projections will typically be located within the exterior telescoping member 130. Consequently, the first and second plurality of projections 170, 172 will not be visible to the user or consumer. In contrast, the first and second plurality of projections 70, 72 of the telescoping assembly 10 may be visible to the user or consumer.

The first and second plurality of projections 170, 172 of the telescoping assembly 110 are preferably constructed using a similar method used to form the projections 70, 72 of the telescoping assembly 10. However, because the projections 170, 172 extend outwardly rather than inwardly, a collet (not shown) with a smaller diameter and outwardly extending bumps may be used to form the outwardly extending projections in the interior telescoping member 132. Additionally, the projections 170, 172 may extend outwardly until they contact a rim with rounded and/or generally planar interior surfaces that function in a similar manner as the arbor 92 to limit the outward extension of the projections 170, 172. Thus, the size of the projections 170, 172 are limited in size by the rim, and that allows the projections to be quickly and easily formed with the desired size and configuration.

Figure 6:
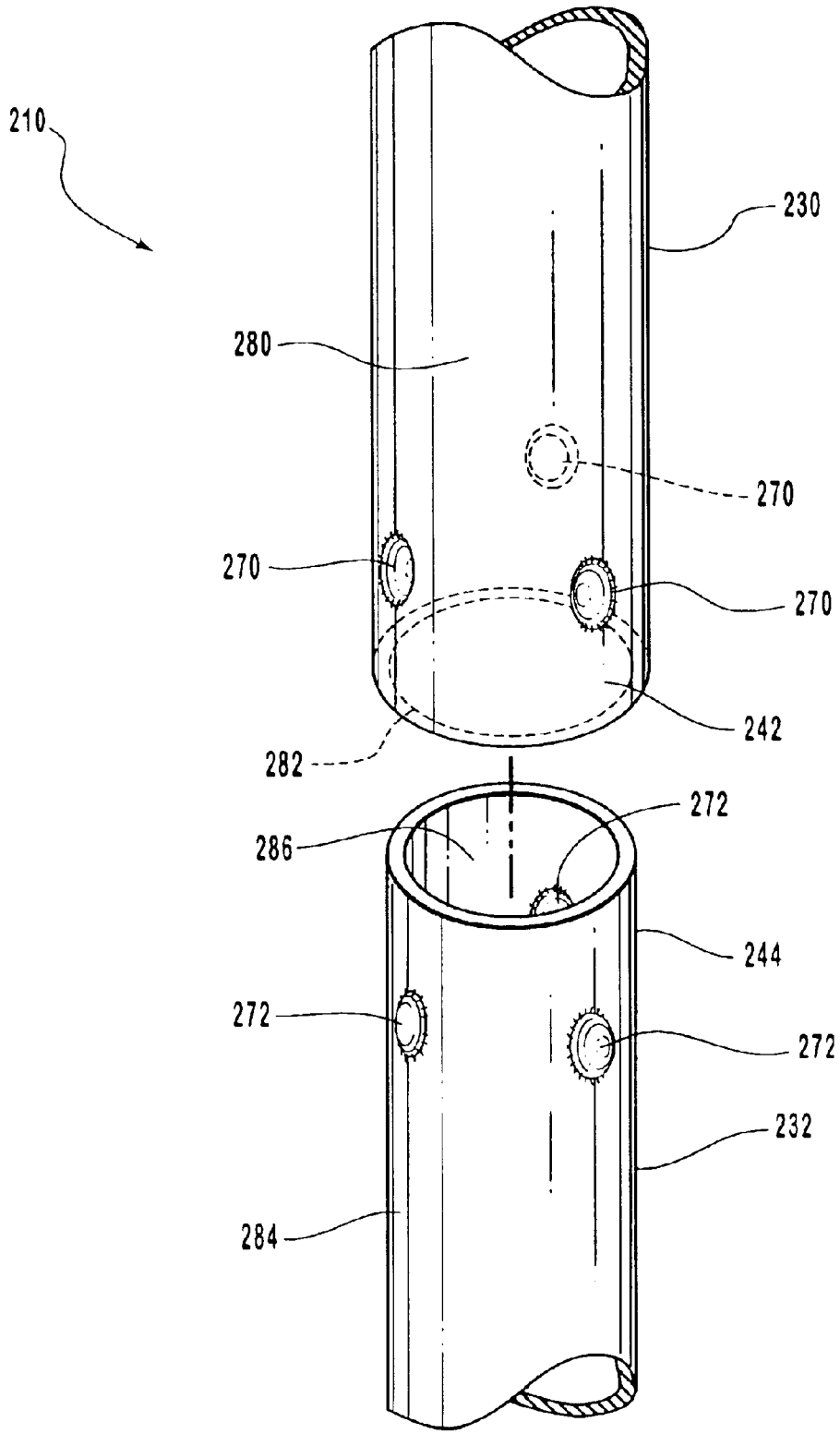
FIG. 6 is an enlarged, perspective view of a portion of a telescoping assembly in accordance with still another preferred embodiment of the present invention, illustrating a plurality of outwardly extending projections on an outer surface of an interior telescoping member and a plurality of inwardly extending projections on an inner surface of an exterior telescoping member.

Another embodiment of a telescoping assembly 210 is shown in FIG. 6. In this embodiment, the telescoping assembly 210 includes an exterior telescoping member 230 and an interior telescoping member 232. The interior telescoping member is sized and configured to fit within the exterior telescoping member 230 with a clearance or gap. The telescoping assembly 210 includes a first plurality of projections 270 formed in the exterior telescoping member 230 and a second plurality of projections 272 formed in the interior telescoping member 232. The first plurality of projections 270 extend inwardly from the exterior telescoping member 230 to contact the interior telescoping member 232, and the second plurality of projections 272 extend outwardly to contact the exterior telescoping member 230. Thus, the interior and exterior telescoping members 232, 230 are held in a spaced apart configuration by the projections 270, 272.

In greater detail, the exterior telescoping member 230 includes an outer surface 280 and an inner surface 282, and the interior telescoping member 232 includes an outer surface 284 and an inner surface 286. As shown in FIG. 6, the first plurality of projections 270 are disposed near a second end 242 of the exterior telescoping member 230 and the second plurality of projections 272 are disposed near a first end 244 of the interior telescoping member 232. In order to connect the first and second telescoping members 230, 232, the first end 244 of the interior telescoping member with the second plurality of projections 272 may be inserted into the exterior telescoping member and moved past the first plurality of projections 270. In order to prevent the first and second plurality of projections 270, 272 from interfering with each other during assembly, the telescoping members may be rotated somewhat with respect to each other so that the first and second plurality of projections can slide past each other. Alternatively, a second end of the interior telescoping member 232 may be inserted into a first end of the exterior telescoping member 230 such that the first and second plurality of projections 270, 272 are never required to slide past each other.

Advantageously, when the interior telescoping member 232 is only partially extended from the exterior telescoping member 230, the first and second plurality of projections 270, 272 are disposed proximate the opposite ends of the telescoping assembly 210. This large distance or displacement between the plurality of projections 270, 272 provides greater stability in the telescoping assembly 210, which further assists in preventing undesirable wobble or lateral movement. Conversely, when the interior telescoping member 232 is fully or nearly completely extended from the exterior telescoping member 230 and the projections are 270, 272 are spaced close together, the telescoping assembly 210 may be more susceptible to wobbling or undesired lateral movement. Thus, this configuration may be particularly useful when a large degree of relative movement between the telescoping members is not desired or infrequently occurs.

The first and second plurality of projections 270, 272 are desirably formed in the manner as described above. Specifically, the first plurality of projections 270 may be formed as depicted in FIG. 4 and the second plurality of projections 272 maybe formed as described above. It will be appreciated, however, that the plurality of projections 270, 272 may be formed by any suitable manner and may have any appropriate size and configuration depending, for example, upon the intended use of the telescoping assembly 210.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed and desired to be secured by United States Letters Patent is:

1. A telescoping assembly comprising:

an exterior telescoping member including a length, a width, an inner surface and an outer surface, the inner surface and the outer surface being separated by a generally constant distance so that the exterior telescoping member has a generally constant thickness;

an interior telescoping member that is sized and configured to fit within an opening in the exterior telescoping member;

an annular gap disposed between the interior telescoping member and the exterior telescoping member;

a first plurality of projections inwardly extending from the inner surface of the exterior telescoping member, the first plurality of projections being integrally formed in the exterior telescoping member as part of a unitary, one-piece construction and the exterior telescoping member maintaining a generally constant thickness, the first plurality of projections extending across the annular gap and contacting an outer surface of the interior telescoping member, each of the first plurality of projections having a contact area that is sized and configured to contact the outer surface of the interior telescoping member, the contact area having a length and a width that is generally less than one-half of the width of the exterior telescoping member, the first plurality of projections being sized and configured to permit telescopic sliding of the interior and exterior telescoping members;

a second plurality of projections inwardly extending from the inner surface of the exterior telescoping member, the second plurality of projections being integrally formed in the exterior telescoping member as part of a unitary, one-piece construction and the exterior telescoping member maintaining a generally constant thickness, the second plurality of projections extending across the annular gap and contacting the outer surface of the interior telescoping member, each of the second plurality of projections having a contact area that is sized and configured to contact the outer surface of the interior telescoping member, the contact area having a length and a width that is generally less than one-half of the width of the exterior telescoping member, the second plurality of projections being sized and configured to permit telescopic sliding of the interior and exterior telescoping members; and a distance along the length of the exterior telescoping member separating the first plurality of projections and the second plurality of projections, the distance allowing the interior and exterior telescoping members to remain generally aligned along an axis as the interior and exterior telescoping members are moved.

2. The telescoping assembly of claim 1, wherein the first plurality of projections includes at least three dimples that are integrally formed in the exterior telescoping member.

3. The telescoping assembly of claim 1, wherein the second plurality of projections includes at least three dimples that are integrally formed in the exterior telescoping member.

4. The telescoping assembly of claim 1, further comprising a locking member attached to the exterior telescoping member to lock the interior and exterior telescoping members in a fixed position.

5. The telescoping assembly of claim 1, further comprising a locking member attached to the interior telescoping member to lock the interior and exterior telescoping members in a fixed position.

6. A telescoping assembly comprising:

an exterior telescoping member;

an interior telescoping member that is sized and configured to fit within an opening in the exterior telescoping member, the interior telescoping member including a length, a width, an inner surface and an outer surface, the inner surface and the outer surface being separated by a generally constant distance so that the interior telescoping member has a generally constant thickness;

an annular gap disposed between the interior telescoping member and the exterior telescoping member;

a first plurality of projections outwardly extending from an outer surface of the interior telescoping member, the first plurality of projections being integrally formed in the interior telescoping member as part of a unitaxy, one-piece construction and the interior telescoping member maintaining a generally constant thickness, the first plurality of projections extending across the annular gap and contacting an inner surface of the exterior telescoping member, each of the first plurality of projections having a contact area that is sized and configured to contact the inner surface of the exterior telescoping member, the contact area having a length and a width that is generally less than one-half of the width of the interior telescoping member, the first plurality of projections being sized and configured to permit telescopic sliding, of the interior and exterior telescoping members;

a second plurality of projections outwardly extending from the outer surface of the interior telescoping member, the second plurality of projections being integrally formed in the interior telescoping member as part of a unitary, one-piece construction and the interior telescoping member maintaining a generally constant thickness, the second plurality of projections extending across the annular gap and contacting the inner surface of the exterior telescoping member, each of the second plurality of projections having a contact area that is sized and configured to contact the inner surface of the exterior telescoping member, the contact area having a length and a width that is generally less than one-half of the width of the interior telescoping member, the second plurality of projections being sized and configured to permit telescopic sliding of the interior and exterior telescoping members; and a distance along the length of the interior telescoping member separating the first plurality of projections and the second plurality of projections, the distance allowing the interior and exterior telescoping members to remain generally aligned along an axis as the interior and exterior telescoping members are moved.

7. The telescoping assembly of claim 6, wherein the first plurality of projections includes at least three dimples that are integrally formed in the interior telescoping member.

8. The telescoping assembly of claim 6, wherein the second plurality of projections includes at least three dimples that are integrally formed in the interior telescoping member.

9. The telescoping assembly of claim 6, further comprising a locking member attached to the exterior telescoping member to lock the interior and exterior telescoping members in a fixed position.

10. The telescoping assembly of claim 6, further comprising a locking member attached to the interior telescoping member to lock the interior and exterior telescoping members in a fixed position.

11. A telescoping assembly comprising:

an exterior telescoping member including a length, a width, an inner surface and an outer surface, the inner surface and the outer surface being separated by a generally constant distance so that the exterior telescoping member has a generally constant thickness;

an interior telescoping member that is sized and configured to fit within an opening in the exterior telescoping member, the interior telescoping member including a length, a width, an inner surface and an outer surface, the inner surface and the outer surface being separated by a generally constant distance so that the interior telescoping member has a generally constant thickness;

an annular gap disposed between the interior telescoping member and the exterior telescoping member;

a first plurality of projections inwardly extending from the inner surface of the exterior telescoping member, the first plurality of projections being integrally formed in the exterior telescoping member as part of a unitary, one-piece construction and the exterior telescoping member maintaining a generally constant thickness, the first plurality of projections extending across the annular gap and contacting the outer surface of the interior telescoping member, each of the first plurality of projections having a contact area that is sized and configured to contact the outer surface of the interior telescoping member, the contact area having a length and a width that is generally less than one-half of the width of the exterior telescoping member, the first plurality of projections being sized and configured to permit telescopic sliding of the interior and exterior telescoping members; and a second plurality of projections outwardly extending from the outer surface of the interior telescoping member, the second plurality of projections being integrally formed in the interior telescoping member as part of a unitary, one-piece construction and the interior telescoping member maintaining a generally constant thickness, the second plurality of projections extending across the annular gap and contacting the inner surface of the exterior telescoping member, each of the second plurality of projections having a contact area that is sized and configured to contact the inner surface of the exterior telescoping member, the contact area having a length and a width that is generally less than one-half of the width of the interior telescoping member, the second plurality of projections being sized and configured to permit telescopic sliding of the interior and exterior telescoping members.

12. The telescoping assembly of claim 11, wherein the first plurality of projections includes at least three dimples that are integrally formed in the exterior telescoping member.

13. The telescoping assembly of claim 11, wherein the second plurality of projections includes at least three dimples that are integrally fanned in the interior telescoping member.

14. The telescoping assembly of claim 11, further comprising a locking member attached to the exterior telescoping member to lock the interior and exterior telescoping members in a fixed position.

15. The telescoping assembly of claim 11, further comprising a locking member attached to the interior telescoping member to lock the interior and exterior telescoping members in a fixed position.

16.The telescoping assembly of claim 11, further comprising a table with at least one table support leg, the telescoping assembly forming at least a portion of a table support leg and the telescoping assembly allowing the height of the table to be adjusted.

* * * * *

UNITED STATES PATENT AND TRADEMARK OFFICE

CERTIFICATE OF CORRECTION

PATENT NO. : 6,843,183 B2
DATED : January 18, 2005
INVENTOR(S) : Lynn Curtis Strong It is certified that error appears in the above-identified patent and that said Letters Patent is hereby corrected as shown below:

Column 1,
Line 61, before “excessive amount” insert -- an --

Column 2,
Line 15, before “interpreted” change “maybe” to -- may be --
Line 19, change “tolerances for error.” to -- tolerance for error. --

Column 4,
Line 8, change “rounded configured.” to -- rounded configuration. --

Column 5,
Line 2, change “movement” to -- move --
Line 49, before “lateral movement.” change “undesirably” to -- undesirable --
Line 51, before “hidden from view.” insert -- are --
Line 55, before “collet with bumps” insert -- a --
Line 59, before “positioned” change “maybe” to -- may be --

Column 7,
Line 60, before “having a generally” change “has” to -- as --

Column 8,
Line 37, before “one or more” insert -- with --
Line 57, after “a plurality” insert -- of --

Column 10,
Line 67, change “maybe similar” to -- may be similar --

Column 11,
Line 44, change “then the diameter” to -- than the diameter --

Column 13,
Line 13, change “maybe advantageous” to -- may be advantageous --

Column 15,
Line 57, change “unitaxy,” to -- unitary, --

UNITED STATES PATENT AND TRADEMARK OFFICE

CERTIFICATE OF CORRECTION

PATENT NO. : 6,843,183 B2
DATED : January 18, 2005
INVENTOR(S) : Lynn Curtis Strong It is certified that error appears in the above-identified patent and that said Letters Patent is hereby corrected as shown below:

Column 16,
Line 2, after "sliding" remove ","

Column 18,
Line 7, change "integrally fanned" to -- integrally formed --

Signed and Sealed this

Twenty-eighth Day of June, 2005

JON W. DUDAS
*Director of the United States Patent and Trademark Office*